US006573646B2

(12) United States Patent
Seo

(10) Patent No.: US 6,573,646 B2
(45) Date of Patent: Jun. 3, 2003

(54) STRUCTURE FOR SUPPORTING SHADOW MASK IN COLOR CATHODE RAY TUBE

(75) Inventor: Jeong Seob Seo, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 136 days.

(21) Appl. No.: 09/770,239

(22) Filed: Jan. 29, 2001

(65) Prior Publication Data

US 2001/0013749 A1 Aug. 16, 2001

(30) Foreign Application Priority Data

Feb. 10, 2000 (KR) ..... 00-6219

(51) Int. Cl.[7] ..... H01J 29/80
(52) U.S. Cl. ..... 313/407; 313/402
(58) Field of Search ..... 313/402, 404, 313/406, 407

(56) References Cited

U.S. PATENT DOCUMENTS 5,210,459 A * 5/1993 Lee ..... 313/406
5,557,162 A * 9/1996 Han ..... 313/402
6,288,480 B1 * 9/2001 Takano et al. ..... 313/407
6,320,305 B1 * 11/2001 Ishikawa et al. ..... 313/402

* cited by examiner

*Primary Examiner*—Sandra Brase
(74) *Attorney, Agent, or Firm*—Fleshner & Kim, LLP

(57) ABSTRACT

Structure for supporting a shadow mask in a color cathode ray tube including main frames each extended along a long side having the shadow mask welded thereto directly, subframes each extended along a short side connected to the main frames for supporting the main frame, plate type supporting members each fitted to a position of an outer surface of respective frames, and elastic members having one side coupled to a stud pin on an inside surface of the panel, and the other side fitted to the supporting member, wherein the supporting member of the subframe includes a first and a second flanges opposite to each other extended downward vertically, and a parallel part extended horizontally between the first and second flanges, thereby maintaining a uniformity of welding quality during cathode ray tube fabrication and preventing color distortion during operation of the cathode ray tube.

27 Claims, 3 Drawing Sheets

STRUCTURE FOR SUPPORTING SHADOW MASK IN COLOR CATHODE RAY TUBE

BACKGROUND OF THE INVENTION

1. Field of the Invention

The present invention relates to a color cathode ray tube, and more particularly, to a structure which can support a shadow mask spaced from an inside surface of a panel.

2. Background of the Related Art

In general, the cathode ray tube is used as an important component in a display, such as a TV receiver or computer monitor, for displaying a picture. A color of electron beams emitted from an electron gun in the cathode ray tube is selected at the shadow mask, for which the shadow mask is spaced for a required distance from the panel of the cathode ray tube by a supporting structure having a frame and the like.

FIG. 1 illustrates a section of an assembly of related art panel and a structure for supporting a shadow mask, referring to which the structure for supporting a shadow mask will be explained.

The structure for supporting a shadow mask is provided with a frame 3 having the shadow mask 2 fitted thereto under a tensile stress, supporting members 10 each fitted to an outer surface of the frame 3, and an elastic member 5 fixed to each of the supporting member. In more detail, the frame 3 has main frames 3*a* extended along long sides having the shadow mask 2 welded thereto directly, and subframes 3*b* extended along short sides connected to the main frames 3*a* for supporting the main frames 3*a*. In welding the shadow mask 2 to the frame 3, a compressive load is applied to the frame 3 in a short side direction for exerting a tension to the shadow mask 2 upon releasing the compressive load applied to the frame 3 after the welding is finished. The elastic member 5, a partially bent plate, having one side with a hole 5*a* inserted in a stud pin 1*a* on the inside surface of the panel 1 and the other side welded to the supporting member 10. To keep a position of the shadow mask 2 fixed regardless of varying conditions in the cathode ray tube, length, width, and angle of the bent of the elastic member 5 are taken into account before formation of the elastic member 5. The supporting member 10 has one side welded to the frame 3 and the other side welded to the elastic member 5 so as to be disposed between, and connect the elastic member 5 and the frame 3. There is a Self Thermal Compensating(STC) device 4 fitted to a bottom surface of the subframe 3*b* for preventing the tensile stress from being lost owing to a difference of thermal expansion coefficients between the frame 3 and the shadow mask 2 in a following process. Thus, the foregoing structure for supporting the shadow mask supports the shadow mask such that the shadow mask is maintained to be spaced a fixed distance from the panel 1. Particularly, the structure for supporting the shadow mask regulates position variation of the shadow mask 2 and the frame 3 caused by thermal expansion, to prevent color distortion.

In the meantime, a structure for supporting the shadow mask different from the foregoing structure may be used due to reasons on fabrication processes and design. One example of such structure is shown in FIG. 3.

Alike the structure in FIG. 1, the structure for supporting a shadow mask in FIG. 3 is provided with a frame 6, supporting members 10, and elastic members 5. The supporting members 10 and elastic members 5 are identical to the structure in FIG. 1. Only the frame 6 is different from the frame in FIG. 1. That is, the main frame 6*a* has a right-angled triangular section for reducing a residual deformation in the compressive deformation, and the subframe 6*b* connected between the main frames 6*a* has a low height for enhancing own rigidity.

Though the structure for supporting a shadow mask carries out basic functions of maintaining the shadow mask 2 spaced a distance from the panel 1 and regulating position variation of the shadow mask 2, the structure for supporting a shadow mask has the following problems.

First, welding between the supporting member 10 and the elastic member 5 is impossible due to the frame structure. The supporting member 10 is resistance spot welded to the frame 3, and 6, and the elastic member 5 is also resistance spot welded to the supporting member 10. In the resistance spot welding, welding objects are inserted between upper and lower electrodes, to weld the welding objects by means of a resistive heat of the welding objects, which is easy to weld and has a low equipment cost such that the resistance spot welding is used in most of process. In the case of the structure for supporting a shadow mask shown in FIGS. 1 and 2, a height of a position 'D' of the hole 5*a* is adequate from the subframe 3*b* enough to weld the elastic member 5 to the supporting member 10 without interference of the welding electrodes. That is, since the height of position 'D' of the welding spot for welding the elastic member 5 to the supporting member 10 is made adequate according to the position of the hole 5*a*, placing the welding electrodes to the welding objects is easy. However, in the structure for supporting a shadow mask shown in FIG. 3, since an overall height is designed low for enhancing a structural rigidity of the frame, the height of the position 'D' of the hole 5*a* in the elastic member 5 is either inadequate or lower than the subframe 6*b*. That is, because the position 'D' of a point for welding elastic member 5 to the supporting member 10 is formed lower then an upper surface of the subframe 6*b*, the welding electrodes can not be inserted. Consequently, though either change of a shape of the supporting member 10 or application of another method, is required, application of another method deteriorates a uniformity of quality, and requires a high investment cost.

Second, the work to fix the structure for supporting shadow mask at a fixed distance from a sidewall of the panel 1 is complicate. As described, since the frames 3 and 6 are compressed to give a tension to the shadow mask 2, there are residual deformations left in the main frames 3*a* and 6*a* and the subframes 3*b* and 6*b*. Eventually, dimensions of the frames 3 and 6 are changed after completion of welding of the shadow mask 2 to the frames 3 and 6 without fail. Alike the thermal expansion of the shadow mask 2, since the dimensional change of the frames 3 and 6 also affect color distortion of a picture, the dimensional change of the frames is required to be adjusted appropriately at the time of fitting the structure for supporting a shadow mask. However, change of a shape of the elastic member 5 is not easy because the elastic member 5 is form to be consistent with the gap preset between the supporting structure and the sidewall of the panel 1. Therefore, in order to maintain the gap between the structure for supporting a shadow mask and the sidewall of the panel 1, dimensions of deformed frames 3 and 6 are required to be measured every time, for adjusting deformation of the supporting member 10.

SUMMARY OF THE INVENTION

Accordingly, the present invention is directed to a structure for supporting a shadow mask that substantially obviates one or more of the problems due to limitations and disadvantages of the related art.

An object of the present invention is to provide a structure for supporting a shadow mask, in which resistance spot welding can be carried out regardless of a frame structure, facilitating to maintain a uniform welding quality.

Another object of the present invention is to provide a structure for supporting a shadow mask, which can maintain a gap between the panel and the sidewall with easy, for preventing color distortion.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the structure for supporting a shadow mask in a color cathode ray tube includes main frames each extended along a long side having the shadow mask welded thereto directly, subframes each extended along a short side connected to the main frames for supporting the main frame, plate type supporting members each fitted to a position of an outer surface of respective frames, and elastic members having one side coupled to a stud pin on an inside surface of the panel, and the other side fitted to the supporting member, wherein the supporting member of the subframe includes, a first and a second flanges opposite to each other extended downward vertically, and a parallel part extended horizontally between the first and second flanges.

The first flange preferably includes a horizontal bent part, and the parallel part has a length in a range of 4 mm~10 mm for inserting a low electrode.

Preferably, the bent part of the first flange is welded on a top surface of the frame for avoiding interference with a thermal compensating device in the shadow mask, and a length of a welding surface of the bent part of the first flange is adjusted for maintaining a distance between the supporting member and the stud pin constant.

Thus, the present invention permits application of resistance spot welding regardless of a frame structure, and to maintain a uniformity of welding quality and to prevent color distortion since maintenance of a gap to a panel sidewall is easy.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In explanation of embodiments of the present invention, same components will be given same names and symbols, and explanations of which will be omitted.

Figure 4:
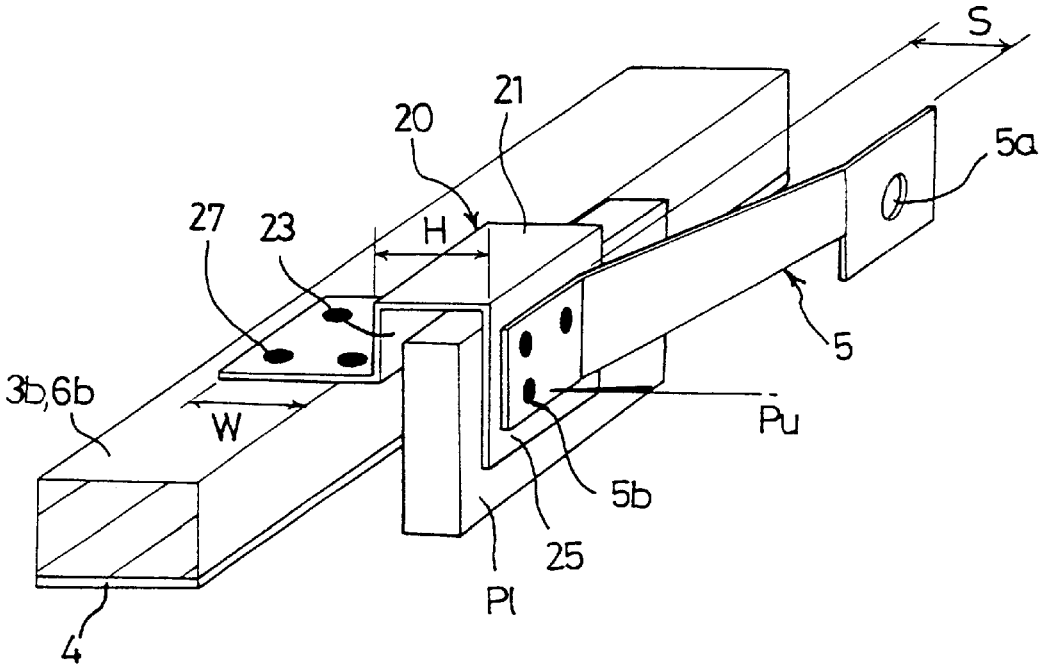

FIG. 4 illustrates a partial perspective view of a structure for supporting a shadow mask in accordance with a preferred embodiment of the present invention, referring to which a structure for supporting a shadow mask in a color cathode ray tube of the present invention will be explained.

Figure 1:
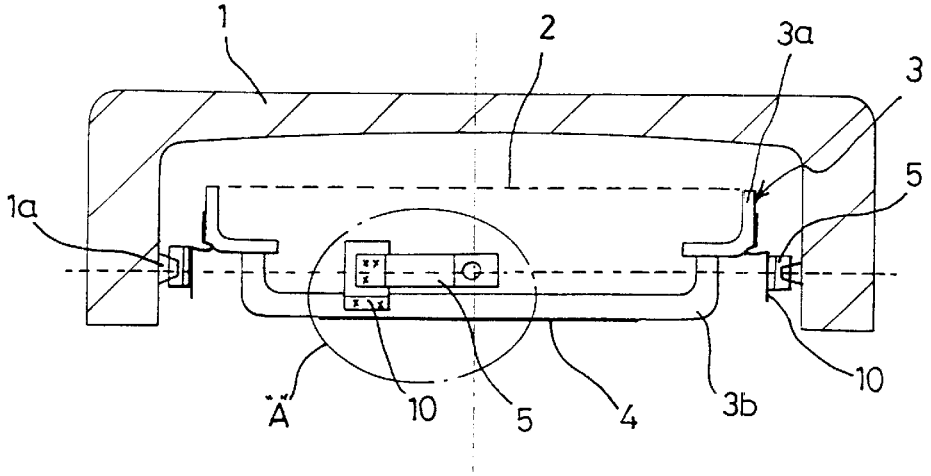
FIG. 1 Prior Art
FIG. 1 illustrates a section of an assembly of related art panel and a structure for supporting a shadow mask.
Figure 2:
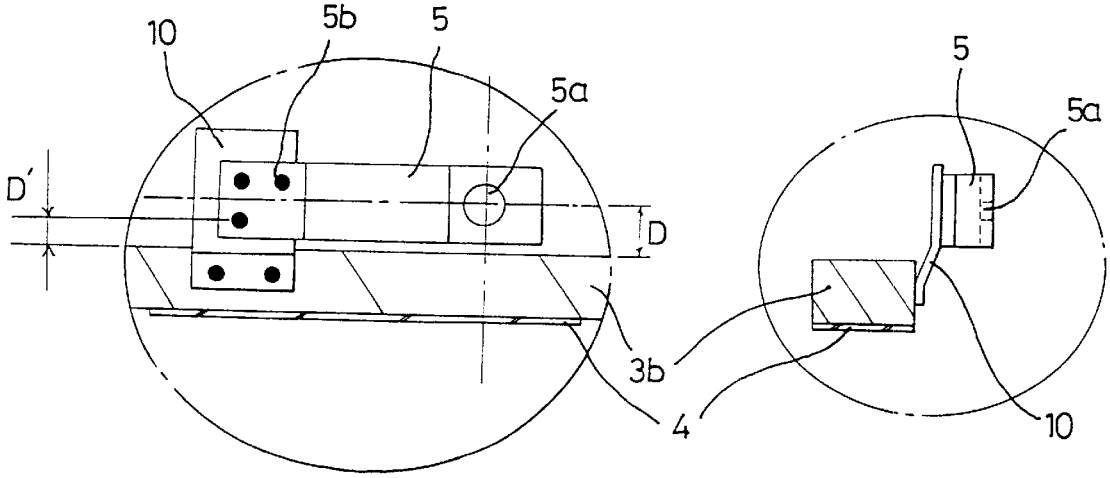
FIG. 2 Prior Art
FIG. 2 illustrates enlarged front and side views of "A" part in FIG. 1.
Figure 3:
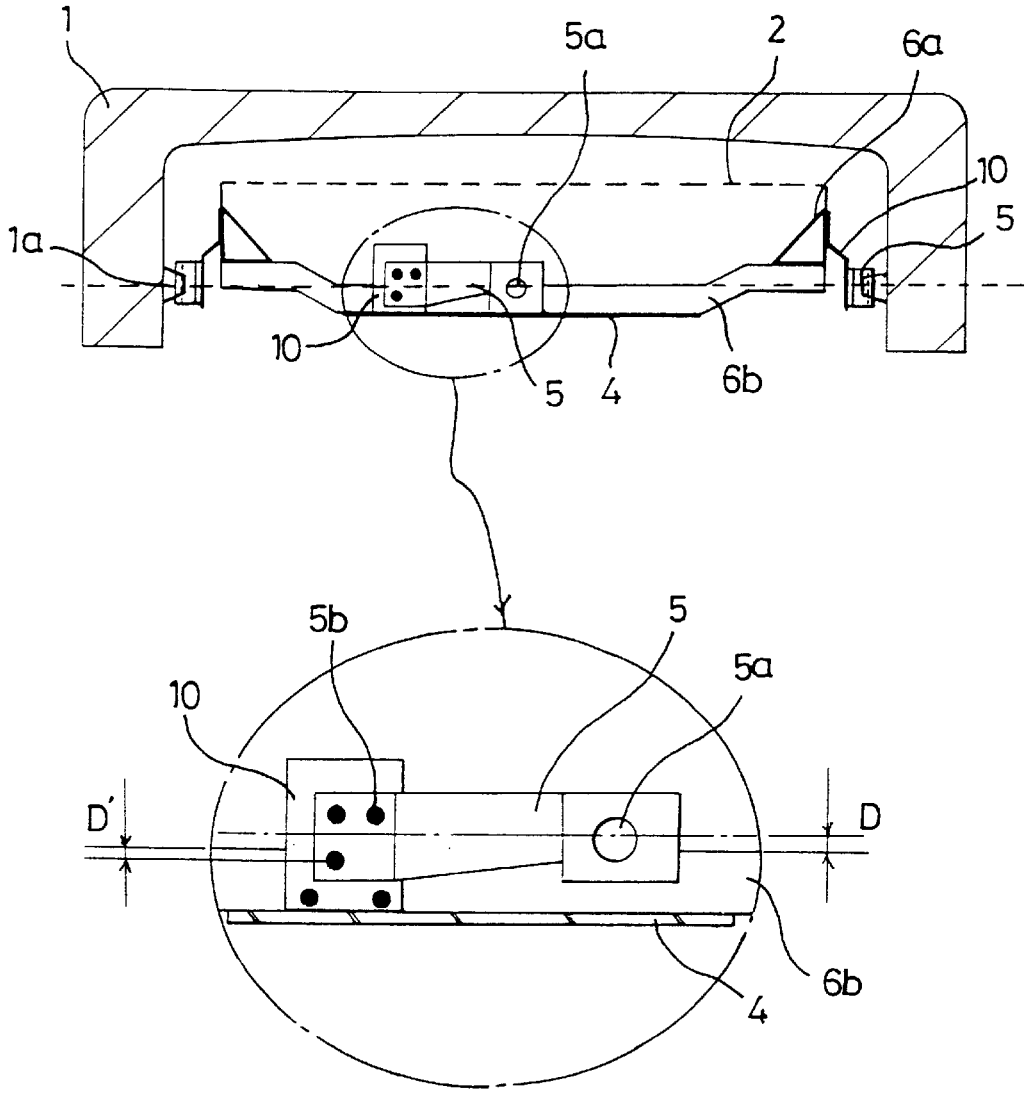
FIG. 3 Prior Art
FIG. 3 illustrates a section of another example of assembly of a related art panel and a structure for supporting a shadow mask; and, FIG. 4 illustrates a partial perspective view of a structure for supporting a shadow mask in accordance with a preferred embodiment of the present invention.

Alike the related art, the structure for supporting a shadow mask in a color cathode ray tube of the present invention in overall includes a shadow mask 2, frames 6, supporting members 20, and elastic members 5. Since the shadow mask 2, the frames 6, and elastic members 5 are identical to the same in the related art shown in FIGS. 1~3, explanations of which will be omitted, and the supporting member 20 will be explained in detail.

Different from the related art structure, the structure of the present invention uses no plate type supporting members 10 at sides of entire frames, uniformly. In detail, though the main frames 3*a* and 6*a* along the long sides use plate type supporting members 10 identical to the related art, the subframes 3*b* and 6*b* along the short sides use a supporting member 20 having a length of horizontal extension. The supporting member 20 applied to the subframe 3*b* or 6*b* has a channel section in overall. That is, the supporting member 20 includes a first and a second flanges 23 and 25 opposite to each other extended downward vertically, and a parallel part 21 extended in a horizontal direction between the first and second flanges 23 and 25. A width of the supporting member 20 is set to secure an adequate welding part when the supporting member 20 is welded to the frame 6, and a thickness of the welding part is set to be greater than 1.2 mm for preventing puncture during welding. It is preferable that the first flange 23 is formed inclusive of a horizontal bent part 27 for welding the supporting member on a surface of the subframes 3*b* and 6*b*. It is preferable that a length 'H' of the parallel part is set to be in a range of 4 mm~10 mm for allowing insertion of a lower electrode PI therein.

A process for assembling the frames 3 and 6 and the elastic member 5 by using the supporting member 20 will be explained. As explained, the main frames 3*a* and 6*a* use plate type supporting members 10 and fitted to the elastic members 5 in a fashion identical to the related art, any further explanation of which will be omitted.

On the other hand, with regard to the subframes 3*b* and 6*b*, the bent part 27 of the channel type supporting member 20 is welded on a top surface of the subframe 3*b* or 6*b* of the frames 3 and 6 having the shadow mask 2 welded thereto. As welding spots are on the top surface of the subframe 6*b*, an interference by the supporting member 20 to the self thermal compensating device 4 fixed on a surface under the subframe 3*b* and 6*b* can be avoided. That is, a functional deterioration of the self thermal compensating device 4 caused by direct transmission of heat generated during sideway welding as the supporting member 20 is in direct contact with the self thermal compensating device 4 can be avoided. Then, a short side elastic member 5 is welded to the second flange 25 of the supporting member 20 by inserting the lower electrode PI into a lower side of the parallel part 21, i.e., rear of the second flange 25 of the supporting member 20, and placing the upper electrode Pu to put the second flange 25 and one side of the elastic member 5 between the lower electrode PI and the upper electrode Pu.

The employment of the supporting member 20 of the present invention permits application of the resistance welding, not only to a general frame 3, but also to a frame 6 with a low total height. That is, in the frame 6, even if the height of the position 'D' of the hole 5*a* of the elastic member 5 is lower than the top surface of the subframe 6*b*, the supporting member 20 and the elastic member 5 can be welded by resistance spot welding, because the supporting member 20 provides an adequate space for inserting the lower electrode PI.

In the meantime, as explained, dimensions of the frames 3 and 6 are changed by the application of compressive load during welding of the shadow mask 2, since the elastic member 5 is designed to an optimal shape for supporting the frame 3 or 6, it is not preferable to change dimensions of the elastic member 5 for adjusting a distance 'S'. However, in the supporting member 20 of the present invention, a welding length 'W' of the bent part 27 can be adjusted according to extent of deformation of the frame 6, to keep the distance 'S' between the supporting member 20 and the stud pin 1*a* constant, thereby preventing color distortion caused by deformation of the frame 6 during fabrication of the cathode ray tube.

As has been explained, the parallel part with a length in the supporting member of the structure for supporting a shadow mask of the present invention permits resistance spot welding regardless of a frame structure, which in turn permits easy welding and to maintain a uniform welding quality. The adjustable frame welding length of the supporting member permits to maintain a gap between the panel and the sidewall easy, that prevents a color distortion in the picture.

It will be apparent to those skilled in the art that various modifications and variations can be made in the structure for supporting a shadow mask in a color cathode ray tube of the present invention without departing from the spirit or scope of the invention. Thus, it is intended that the present invention cover the modifications and variations of this invention provided they come within the scope of the appended claims and their equivalents.

What is claimed is:

1. A structure for supporting a shadow mask in a cathode ray tube, comprising:

main frames each extended along a long side having the shadow mask welded thereto directly;

subframes each extended along a short side connected to the main frames for supporting the main frames;

plate type supporting members each fitted to a position on a surface of a respective one of the frames, the supporting member of the subframe being fitted on a top surface of the subframe and including:

first and second flanges opposite to each other, wherein the second flange extends downward vertically; and a parallel part extending horizontally between the first and second flanges; and elastic members having one side coupled to a stud pin on an inside surface of a panel of the cathode ray tube, and the other side fitted to the supporting member.

2. The structure as claimed in claim 1, wherein the first flange includes a horizontal bent part.

3. The structure as claimed in claim 2, wherein the bent part of the first flange is welded on a top surface of the frame for avoiding interference with a thermal compensating device of the subframe.

4. The structure as claimed in claim 2, wherein a length of a welding surface of the bent part of the first flange is adjusted for maintaining a distance between the supporting member and the stud pin constant.

5. The structure as claimed in claim 1, wherein the parallel part has a length in a range of 4 mm~10 mm for inserting a low electrode.

6. The structure as claimed in claim 1, wherein the structure is configured to support a shadow mask in a color cathode ray tube.

7. A cathode ray tube comprising the structure of claim 1.

8. The structure as claimed in claim 1, wherein the elastic members each extend along a length of the outer surface of the respective frame with its longitudinal axis parallel to a longitudinal axis of the respective frame.

9. The structure as claimed in claim 1, wherein parallel part is configured to receive therein an electrode for performing spot resistance welding.

10. The structure as claimed in claim 1, wherein a thermal compensating device is installed on a bottom surface of the subframe.

11. A structure for supporting a shadow mask in a cathode ray tube, comprising:

main frames each extended along a long side having the shadow mask welded thereto directly;

subframes each extended along a short side connected to the main frames for supporting the main frames;

plate type supporting members each fitted to a position on an outer surface of a respective one of the frames, the supporting member of the subframe including:

first and second flanges opposite to each other extended downward vertically;

the first flange including a horizontal bent part; and a parallel part extending horizontally between the first and second flanges; and elastic members having one side coupled to a stud pin on an inside surface of a panel of the cathode ray tube, and the other side fitted to the supporting member.

12. The structure as claimed in claim 11, wherein the bent part of the first flange is welded on a top surface of the frame for avoiding interference with a thermal compensating device of the subframe.

13. The structure as claimed in claim 11, wherein a length of a welding surface of the bent part of the first flange is adjusted for maintaining a distance between the supporting member and the stud pin constant.

14. A cathode ray tube comprising the structure of claim 11.

15. The structure as claimed in claim 11, wherein a thermal compensating device is installed on a bottom surface of the subframe.

16. A structure for supporting a shadow mask in a cathode ray tube, comprising:

main frames each extended along a long side having the shadow mask welded thereto directly;

subframes each extended along a short side connected to the main frames for supporting the main frames;

plate type supporting members each fitted to a position on an outer surface of a respective one of the frames, the supporting member of the subframe including:

first and second flanges opposite to each other extended downward vertically; and a parallel part extending horizontally between the first and second flanges, the parallel part having a length in a range of 4 mm~10 mm for inserting a low electrode; and elastic members having one side coupled to a stud pin on an inside surface of a panel of the cathode ray tube, and the other side fitted to the supporting member.

17. A cathode ray tube comprising the structure of claim 16.

18. The structure as claimed in claim 16, wherein a thermal compensating device is installed on a bottom surface of the subframe.

19. A structure for supporting a shadow mask in a cathode ray tube, comprising:

main frames having the shadow mask welded thereto;

subframes connected to the main frames and configured to support the main frames;

plate type supporting members each attached to an outer surface of a respective one of the frames; and elastic members each having one side coupled to a stud pin on an inside surface of a panel of the cathode ray tube, and the other side fitted to the supporting member, wherein the supporting member of the subframe includes:

a first flange configured to be attached to the outer surface of the respective frame;

a second flange configured to be spot resistance welded to the respective elastic member; and a portion extending between the first and second flanges configured to receive therein an electrode for performing the spot resistance welding.

20. The structure as claimed in claim 19, wherein the first flange includes a horizontal bent part.

21. The structure as claimed in claim 20, wherein the bent part of the first flange is welded on a top surface of the frame for avoiding interference with a thermal compensating device of the subframe.

22. The structure as claimed in claim 20, wherein a length of a welding surface of the bent part of the first flange is adjusted for maintaining a distance between the supporting member and the stud pin constant.

23. The structure as claimed in claim 19, wherein the portion extending between the first and second flanges has a length in a range of 4 mm~10 mm for therein the electrode.

24. A cathode ray tube comprising the structure of claim 19.

25. The structure as claimed in claim 19, wherein the elastic members each extend along a length of the outer surface of the respective frame with its longitudinal axis parallel to a longitudinal axis of the respective frame.

26. The structure as claimed in claim 19, wherein the first flange extends substantially horizontally and the second flange extends downward vertically.

27. The structure as claimed in claim 19, wherein a thermal compensating device is installed on a bottom surface of the subframe.

* * * * *